US008441388B2

(12) United States Patent
Lee et al.

(10) Patent No.: US 8,441,388 B2
(45) Date of Patent: May 14, 2013

(54) REMOTE CONTROL DEVICES AND METHODS

(75) Inventors: Ka Yuk Lee, Kowloon (CN); Qing Shan, Shatin (HK); Tak Wing Lam, Kowloon (CN); Yeaun Jau Liou, Shatin (HK)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 748 days.

(21) Appl. No.: 12/582,498

(22) Filed: Oct. 20, 2009

(65) Prior Publication Data

US 2010/0171636 A1 Jul. 8, 2010

Related U.S. Application Data

(63) Continuation-in-part of application No. 12/349,263, filed on Jan. 6, 2009, now Pat. No. 8,130,134.

(51) Int. Cl.
*G08C 19/12* (2006.01)

(52) U.S. Cl.
USPC ..... 341/176; 341/22

(58) Field of Classification Search ..... 341/22, 341/176; 400/714; 345/156–158; 463/37
See application file for complete search history.

(56) References Cited

U.S. PATENT DOCUMENTS

| | | | | |
|---|---|---|---|---|
| 6,028,593 | A * | 2/2000 | Rosenberg et al. | 345/156 |
| 6,346,891 | B1 | 2/2002 | Feinleib et al. | |
| 6,624,806 | B2 | 9/2003 | Hsu | |
| 6,975,301 | B2 | 12/2005 | Fan | |
| 7,239,301 | B2 | 7/2007 | Liberty et al. | |
| 7,489,298 | B2 | 2/2009 | Liberty et al. | |
| 7,489,299 | B2 | 2/2009 | Liberty et al. | |
| 7,535,456 | B2 | 5/2009 | Liberty et al. | |
| 7,683,883 | B2 * | 3/2010 | Touma et al. | 345/163 |
| 7,931,535 | B2 * | 4/2011 | Ikeda et al. | 463/38 |
| 7,938,725 | B2 * | 5/2011 | Okamura | 463/37 |
| 8,217,795 | B2 * | 7/2012 | Carlton-Foss | 340/573.1 |
| 8,231,465 | B2 * | 7/2012 | Yee et al. | 463/32 |
| 8,284,847 | B2 * | 10/2012 | Adermann | 375/240.29 |
| 2006/0184966 | A1 | 8/2006 | Hunleth et al. | |
| 2008/0158154 | A1 | 7/2008 | Liberty et al. | |
| 2008/0222675 | A1 | 9/2008 | Moshiri et al. | |

* cited by examiner

*Primary Examiner* — Brian Young
(74) *Attorney, Agent, or Firm* — Fulbright & Jaworski L.L.P.

(57) ABSTRACT

A remote control device comprising a motion detector consisting of a single accelerometer, means for receiving data from the motion detector and mapping the received motion detector data to at least one user instruction, and means for transmitting a signal indicative of the at least one user instruction.

26 Claims, 13 Drawing Sheets

REMOTE CONTROL DEVICES AND METHODS

CROSS-REFERENCE TO RELATED APPLICATIONS

The present application is a continuation-in-part of, and claims priority to, U.S. patent application Ser. No. 12/349,263, entitled "Reduced Instruction Set Television Control System and Method of Use," filed Jan. 6, 2009, the disclosure of which is hereby incorporated by reference herein in its entirety.

TECHNICAL FIELD

The present description relates, generally, to remote control techniques and relates, more specifically, to remote control techniques using a single accelerometer.

BACKGROUND

Various remote controls are available in the marketplace today to control televisions, video games, set top boxes, and the like. One example is the ubiquitous infrared television remote control which includes an array of single-purpose buttons and communicates with an entertainment unit using an infrared Light Emitting Diode (LED). Some such remote controls have an extraordinary number of buttons that cause such remote controls to be confusing to use and physically bulky.

Another example is the remote controller that interfaces with the Nintendo™ Wii™ entertainment system. The Wii™ remote control (a.k.a., the "Wiimote") includes a three-dimensional accelerometer and an optical sensor. The accelerometer facilitates the remote control's detection of movement, while the optical sensor is adapted to receive light from a sensor bar to more accurately determine the position of the remote control in space. The Wii™ remote control is robust but expensive and requires the use of a separate sensor bar.

An additional remote control device, described in U.S. Pat. No. 7,489,298, has a rotation sensor and acceleration sensor to detect motion of a 3D pointing device and map motion into a desired output. However, using a rotation sensor in addition to an accelerometer increases cost. There is currently no remote control device on the market that provides adequate performance using a single accelerometer unsupplemented by additional accelerometers, sensor bars, rotational sensors, and the like.

BRIEF SUMMARY

Various embodiments of the invention are directed to systems, methods, and computer program products providing remote control techniques using a motion sensor that includes a single two-dimensional or three-dimensional accelerometer. Various embodiments can implement tilt-based pointing, tilt-based commands, movement-based commands, and shaking commands.

Various embodiments also include one or more unique filters and/or algorithms. For instance, some embodiments filter raw accelerometer data by using a zero-delay averaging filter, a zero-well filter, and a high/low clip filter combination to transform the sensor data into readily useable pre-processed data. The pre-processed data makes the remote control device less susceptible to jittery operation and false command triggering. In another example, some embodiments include tilt-based command algorithms, movement-based command algorithms, and shake-based command algorithms. Various embodiments provide for a robust, intuitive, and lower-cost alternative to prior are remote control devices currently available.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
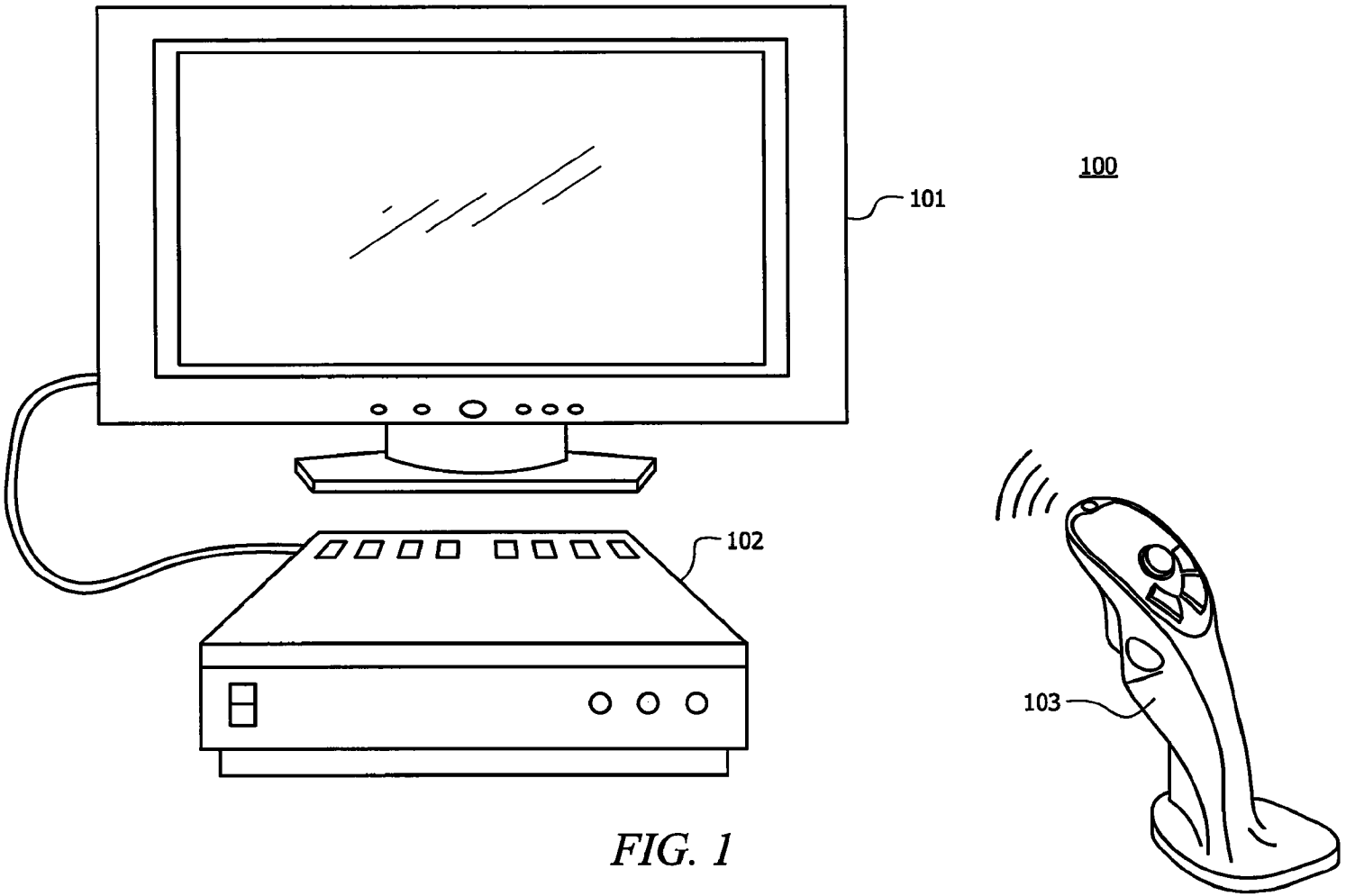
FIG. 1 is an illustration of an exemplary system, adapted according to one embodiment of the invention.

FIG. 1 is an illustration of exemplary system 100, adapted according to one embodiment of the invention. System 100 includes television 101, entertainment device 102 (e.g., a Digital Video Recorder (DVR), a set top box, a video game console, a personal computer, etc.) in communication with television 101, and remote control 103. Remote control 103 is operable to control either or both of television 101 and entertainment device 102 using instructions from a human user (not shown) to change channels, change settings, move cursors, select menu items, and the like. Remote control 103 communicates with television 101 and/or entertainment device 102 through a wireless link, such as an infrared (IR) link, a WiFi link, a Bluetooth™ link, and/or the like. Remote control 103, in this example, includes an ergonomic and intuitive shape that fits a human user's hand and invites the human user to tilt and move remote control 103. Various features of remote control 103 are described in more detail below.

Figure 2:
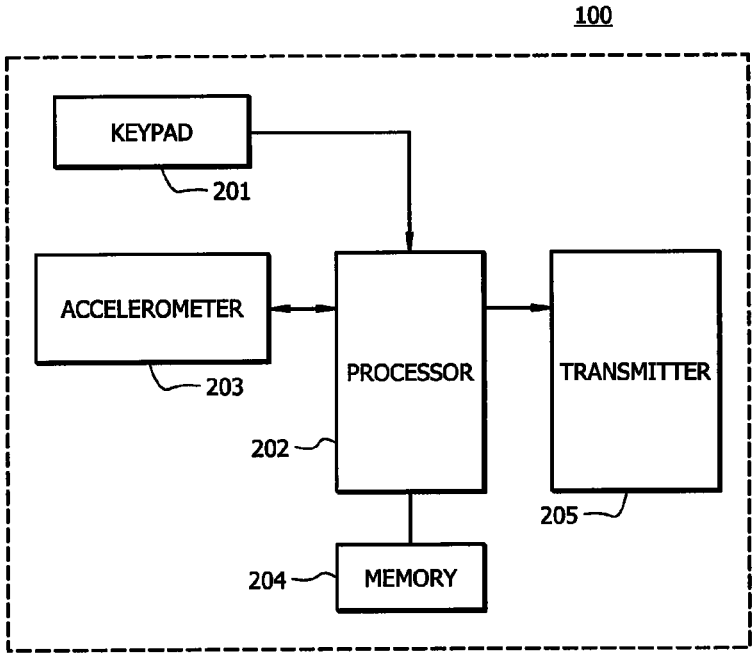
FIG. 2 is a block diagram of exemplary functional units that are included in the exemplary remote control of FIG. 1 according to one embodiment of the invention.

FIG. 2 is a block diagram of exemplary functional units that are included in exemplary remote control 100 (of FIG. 1) according to one embodiment of the invention. Remote control 100 includes keypad 201, processor 202, motion detector 203, memory 204, and wireless transmitter 205. Remote control 100 receives user instructions through keypad 201 as well as through a user's tilting, shaking, and translating motions. User motions are detected by motion detector 203, which in this example includes only a single accelerometer and forgoes additional accelerometers or rotation sensors (e.g., gyroscopes). The accelerometer may be a two-dimensional (2-D) or three-dimensional (3-D) accelerometer. Techniques for processing data from motion detector 201 are described in more detail below with respect to FIGS. 6-8.

Memory 204 can be used to store data and instructions for processor 202. Information received from keypad 201 and motion detector 203 is processed by processor 202 and mapped to one or more commands, as described in more detail below with respect to FIGS. 6 and 9-11. The commands are transmitted to a television or other entertainment unit using wireless transmitter 205. Processor 202 may include a general purpose processor, a Digital Signal Processor (DSP), an Application Specific Integrated Circuit (ASIC), a Microcontroller Unit (MCU), and/or the like. It is understood that FIG. 2 is exemplary, as other embodiments may use somewhat different configurations of functional units.

Figure 3:
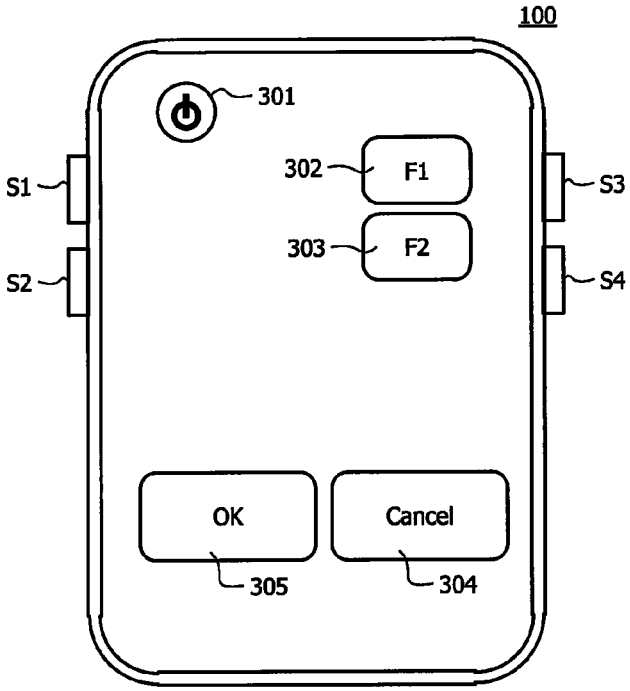
FIG. 3 is a block diagram of exemplary interface features of a remote control device adapted according to one embodiment of the invention.

FIG. 3 is a block diagram of exemplary interface features of remote control device 100 adapted according to one embodiment of the invention. As shown, remote control device 100 includes conventional television remote control keys as well as some keys specially adapted for use with tilting, shaking, and translating motions. For instance, remote control 100 includes an on/off key 301, volume keys 302, 303 and cancel and enter keys 304 and 305. Additionally, remote control 301 includes keys S1-S4, which are specially adapted for use with human movement gestures. For instance, a human user may hold down key 51 in order to indicate that a motion is to be interpreted as a tilt-based pointing instruction. The other keys S2-S4 may also be associated with various functions. It is understood that FIG. 3 is exemplary, as other embodiments may use somewhat different configurations of interface features.

Figure 4:
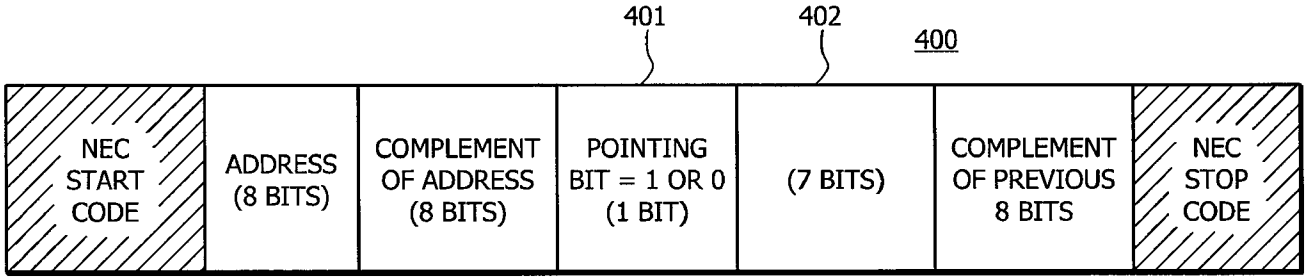
FIG. 4 is an illustration of an exemplary packet, which can be sent from a remote control unit to a television or other entertainment device according to one embodiment of the invention.
Figure 5:
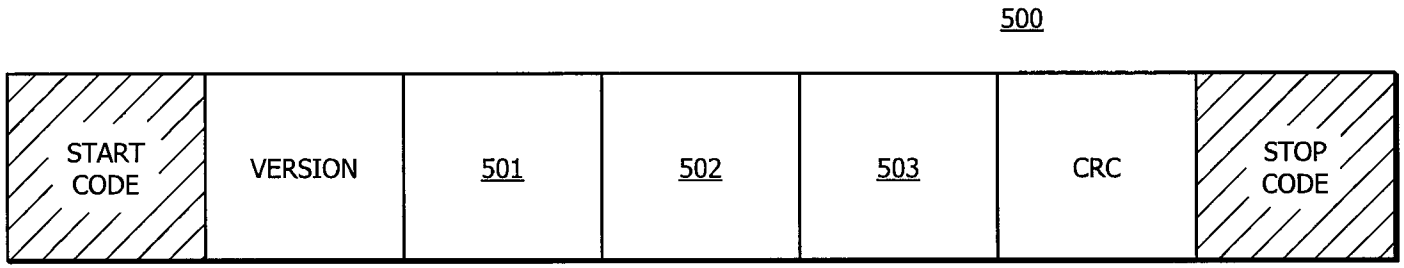
FIG. 5 is an illustration of an exemplary packet, which can be sent from a remote control unit to a television or other entertainment device according to one embodiment of the invention.

Remote control 100 (of FIG. 1) can transmit instructions according to any protocol now known or later developed. FIGS. 4 and 5 illustrate two exemplary protocols for use according to embodiments of the invention. FIG. 4 is an illustration of exemplary packet 400, which can be sent from remote control unit 100 to a television or other entertainment device. Packet 400 is formatted according to the NEC Protocol, which is a standard format for television-type remote controls, and it is commonly used in Asia. Furthermore, packet 400 can be used for discrete commands (e.g., volume up) as well as for pointing-type commands to move a cursor or select an item according to a human user's movement. The two types of commands can be differentiated using data block 401, where, for example, a zero can indicate a discrete command, and a one can indicate a pointing-type command. Data block 402 can be used to carry an indication of a command or can be used to carry pointing data (e.g., four bits for X-axis data and three bits for Y-axis data). Packet 400 may find use in a variety of embodiments, especially those that use a conventional, low-bandwidth IR connection, such as a 16 kbits/sec IR connection commonly used in television remote controls. Other examples of low-bandwidth protocols that may be used in various embodiments include, but are not limited to, the protocol used by Sony, the protocol used by Matsushita, and Rivest Cipher (RC5).

FIG. 5 is an illustration of exemplary packet 500, which can be sent from remote control unit 100 to a television or entertainment device. Packet 500 is shown generically and can be adapted for an arbitrary protocol. Data blocks 501-503 can have an arbitrary number of bits and represent any desired kind of data. An engineer can choose a number of bits to satisfy a desired pointing data resolution while also satisfying a bandwidth limitation. Packet 500 may find use in any of a variety of embodiments, especially those that use a high-bandwidth IR connection or a Radio Frequency (RF) connection (e.g., Bluetooth™, WiFi, etc.).

Figure 6:
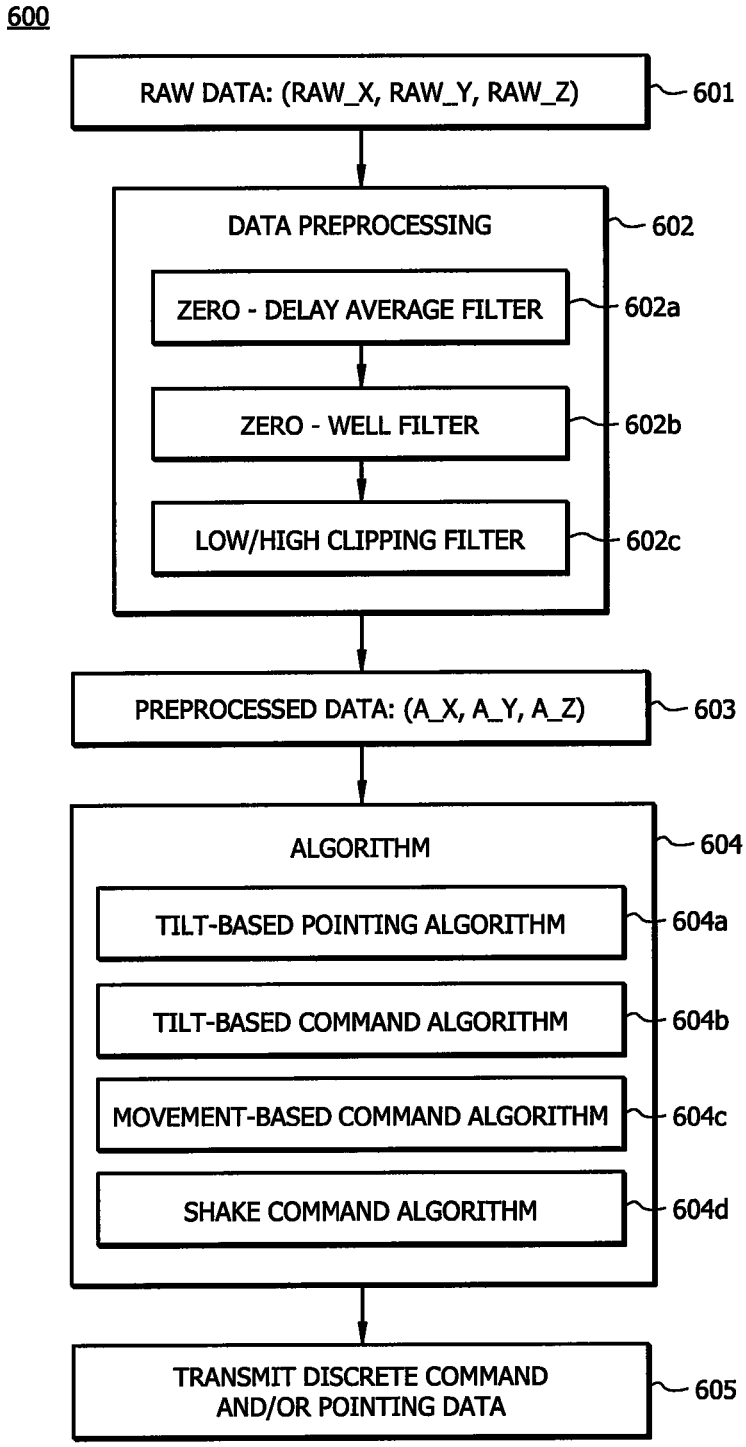
FIG. 6 is an illustration of an exemplary process performed by an exemplary remote control of FIG. 1, according to one embodiment of the invention, for processing acceleration data and transmitting instructions.

FIG. 6 is an illustration of an exemplary process performed by an exemplary remote control (e.g., 100 of FIG. 1), according to one embodiment of the invention, for processing acceleration data and transmitting instructions. In block 601, raw acceleration data is received from, e.g., motion detector 203, and the data can be 2D or 3D data. In block 602, the data is preprocessed using three types of filters in series. Filtering may be performed by a processor, such as processor 202 of FIG. 2, or by one or more hardware- or software-based filtering modules (not shown).

Averaging filter **602*a* is a "zero-delay" averaging filter that smoothes the raw data. A drawback of conventional averaging filters is that they include some amount of delay at startup. In the case of a conventional N-average filter, such filter will incur a delay of N samples before outputting smoothed data. By contrast, filter 602 minimizes the delay by providing an output even if only a single sample is received. Filter 602*a* can be implemented using any of a variety of algorithms, two of which are shown below. The algorithms described below for implementing filter 602*a*** are illustrated with respect to X-axis information, but it is understood that Y- and Z-axis information can be treated in the same way.

In the examples below, i is an index of a particular data received, and N is the number of data used for the average.

X_i is the i-th Raw_X data, and $X_{avg_}$i is the average filter output after receiving X_i. In a first example technique for implementing filter 602*a*, when i is within the range of one to N−1, $X_{avg_}$i=sum(X_1, . . . , X_i)/i. When i is greater than or equal to N, $X_{avg_}$i=sum(X_i−(N+1), . . . , X_i)/N. Accordingly, when i is smaller than N, averaging is performed with fewer than N samples.

In another example technique, $$X_{avg_}i=(w_i1*X_1+w_i2*X_2+\ldots+w_ii*X_i)/N.$$

When i is less than N, w_i1=N−i+1, and w_i2, w_i3, w_i4, . . . , w_ii are each equal to 1. Thus, when i=3 and N=8, w_31=8−3+1=6. Furthermore, following the example in which i=3 and N=8, w_32 and w_33 both equal 1, and Xavg_3=(6*X_1+1*X_2+1*X_3)/8.

When i is greater than or equal to N, w_i1, w_i2, w_i3, w_i4, . . . , w_iN are all set equal to zero, and w_i(N+1), w_i(N+2), . . . , w_ii are all set equal to one. In other words, in this example, the average is taken for the last Nth data. Thus, at least in some instances, minimizing the delay of the averaging filter can, in some embodiments, facilitate processing that has no perceptible delay to the user.

Figure 7:
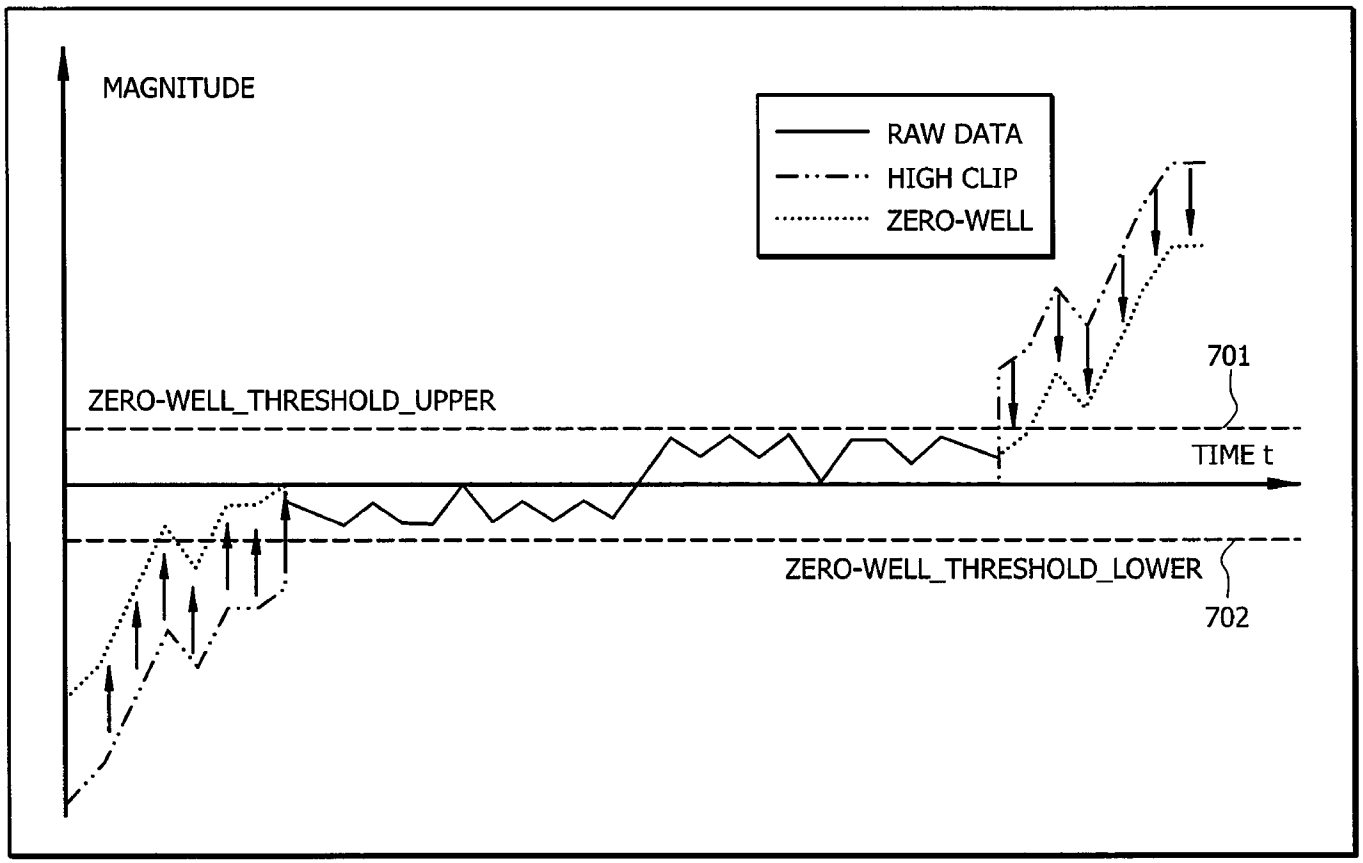
FIG. 7 is an illustration of operation of an exemplary zero-well filter, adapted according to one embodiment of the invention.

Zero-well filter 602*b* is used to eliminate the noisy fluctuation from raw data. Filter 602*b* narrows the range of data (by the zero-well thresholds) to compensate for the values in the threshold zone in a traditional low/high clip approach. The operation of an exemplary zero-well filter, adapted according to an embodiment of the invention, is shown in FIG. 7. Data that falls within the range defined by the two thresholds 701, 702 is set to zero. Data below the threshold 702 is adjusted up by a value equal to the magnitude of the threshold 702. For instance, if the threshold 702 is equal to negative two units, then data falling below negative two units is increased in value by two units. Similarly, data falling above the threshold 701 is reduced by the value of the threshold 701. For instance, if the threshold 701 is equal to two units, then data with a value above two units is decreased in value by two units.

In some embodiments the raw data shows significant fluctuation in the range of, e.g., one to negative twelve, but it is generally undesirable for the user to experience such fluctuations. Thus, filter 602*b* zeros-out small fluctuations. On the other hand, it is generally desirable for the user to be able to use fine movements, say one step forward or one step backward. Shifting the raw data toward zero by the thresholds 701, 702 creates a scenario where, for example, a user gestures with a magnitude otherwise large enough to signal a move of three steps, but the remote control interprets the filtered data as signaling a move of one step. Thus, the user is still able to make fine movements.

Figure 8:
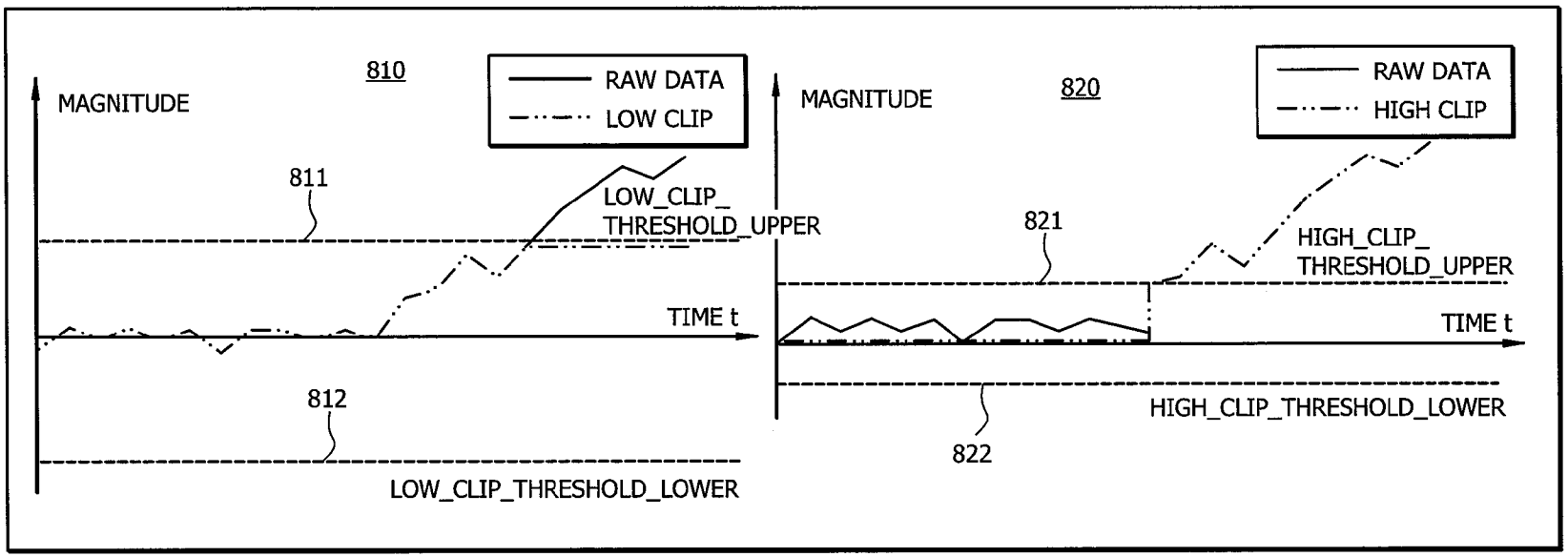
FIG. 8 is an illustration of an exemplary low-clip filter and high-clip filter, adapted according to one embodiment of the invention.

Returning to FIG. 6, filter 602*c* includes both a low-clip filter and a high-clip filter. FIG. 8 is an illustration of exemplary low-clip filter 810 and high-clip filter 820, adapted according to one embodiment of the invention. Low-clip filter 810 clips values above threshold 811, so that high values are set equal to the value of threshold 812. Low clip filter 810 also clips values below threshold 812, so that low values are set equal to the value of threshold 812. High-clip filter 820 zeros-out values that fall within thresholds 821, 822.

Low-clip filter 810 is used to eliminate abrupt changes in the raw data, such as if the user drops the remote control. High-clip filter 820 identifies a dominant change in the raw data but eliminates small movements, such as a tremor of the user's hand. In various embodiments, filters 602*a*-602*c* can be implemented quite simply, thereby providing intended performance at a minimal cost of processing power and delay.

Returning to FIG. 6, the remote control has a preprocessed data set at block 603 that includes the output of the filtering stage 602. The pre-processed data is then used by one or more algorithms at block 604 to generate pointing commands and/or discrete commands. One such algorithm is tilt-based pointing algorithm 604*a* which is used, for example, to point to an item on a screen, similar to the pointing action of a computer mouse. When the remote control is stationary, only the gravitational force acts on the accelerometer, and the gravitational force forms projections on the axes of the accelerometer. When the remote control is tilted, the readings of the acceleration along the various axes (e.g., X, Y, Z-axes in a 3-D example) will change accordingly. Algorithm 604*a* maps the magnitudes of the projection to the position of a cursor on the screen, for instance, by outputting (Pointing_Data_X, Pointing_Data_Y), where X and Y are the axes of the screen on which the cursor is projected.

In one exemplary implementation, upon a state change of button S1 (e.g., button S1 of FIG. 3) from Not Pressed to Pressed, reference accelerometer readings are set as (Ref_X, Ref_Y, Ref_Z) to the current preprocessed accelerometer reading, and the Output, (Pointing_Data_X, Pointing_Data_Y), is set to (0,0). As long as S1 is pressed, a function hereinafter referred to as "OutputPointingData" is performed such that OutputPointingData((A_X, A_Y, A_Z), (Ref_X, Ref_Y, Ref_Z)) equals (Pointing_Data_X, Pointing_Data_Y). OutputPointingData( ) is a function that maps the preprocessed accelerometer reading to movement of a cursor (or other object) about a screen according to the sensitivity of the sensor used and the resolution of the desired pointing data. The pointing data itself is received by the entertainment device and used to move a cursor or other object according to the user's instructions. In one embodiment, OutputPointingData( ) can be implemented as (A_X−Ref_X, A_Y−Ref_Y).

To further adapt to different resolutions of host devices, a scaling factor can be used. For instance, OutputPointing Data( ) can then be implemented as ((A_X−Ref_X)*ScalingX, (A_Y−Ref_Y)*ScalingY). ScalingX and ScalingY may also depends on the input to OutputPointingData( ). In another embodiment, the functions can be implemented as table lookups. In yet another embodiment, the angular movement about the X-, Y- and Z-axes can be calculated from the X, Y, Z readings to provide a more accurate mapping from hand movement to pointing data. Tilt-based pointing algorithms, such as algorithm 604*a*, are known in the art.

Figure 9:
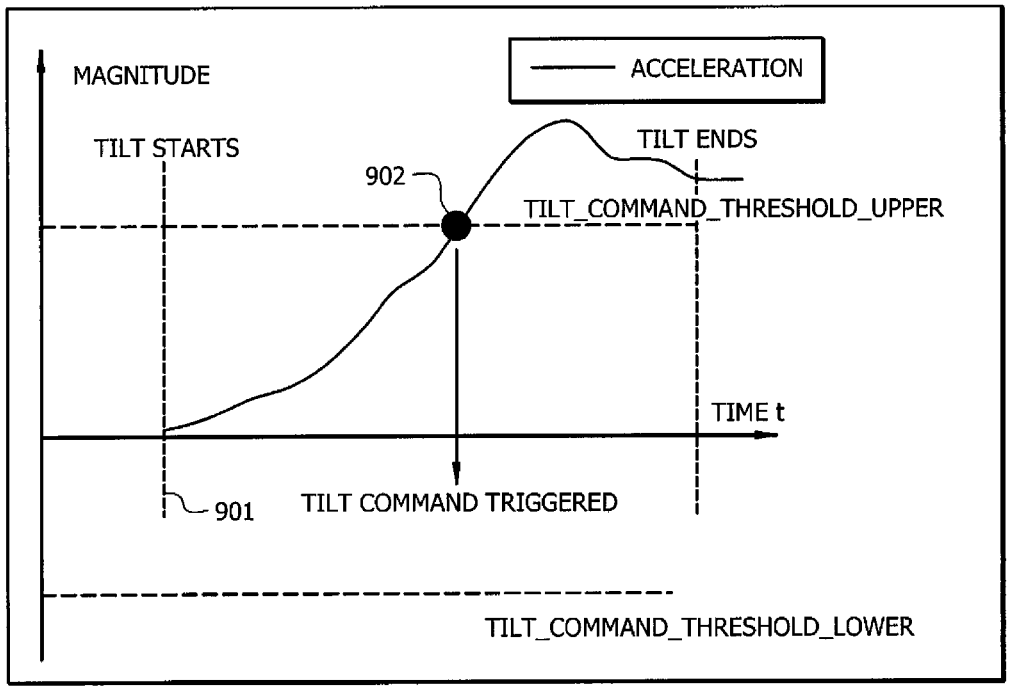
FIG. 9 is an illustration of an accelerometer reading during an exemplary tilt-based command algorithm according to one embodiment of the invention.

Algorithm 604*b* is a tilt-based command algorithm, which receives user input in the form of a tilting movement of the remote control and outputs a discrete command, such as channel up and channel down. As explained above, when the remote control is tilted, the readings of the acceleration along the various axes (e.g., X, Y, Z-axes in a 3-D example) will change accordingly. In one embodiment, a tilt command can be triggered when one of the readings exceeds a predefined threshold. FIG. 9 is an illustration of an accelerometer reading during an exemplary tilt-based command algorithm. At time 901, the tilting starts, and at time 902, the magnitude of the accelerometer readings has exceeded a threshold. At time 902, the remote control processor discerns that the tilting exceeds the threshold and implements the algorithm 604*b*. Tilt-based command algorithms, such as algorithm 604*b* are known in the art.

Algorithm 604*c* is a movement-based command algorithm, which receives user input in the form of translational movement of the remote control and outputs a discrete command, such as page up and page down. When a human user moves the remote naturally, say along the X-axis, the acceleration along the movement direction will have a significant increase followed by a significant decrease. A movement command can be triggered when acceleration is observed to have a significant increase followed by a significant decrease. Various embodiments monitor the rate of change of acceleration in order to trigger movement-based commands.

Figure 10:
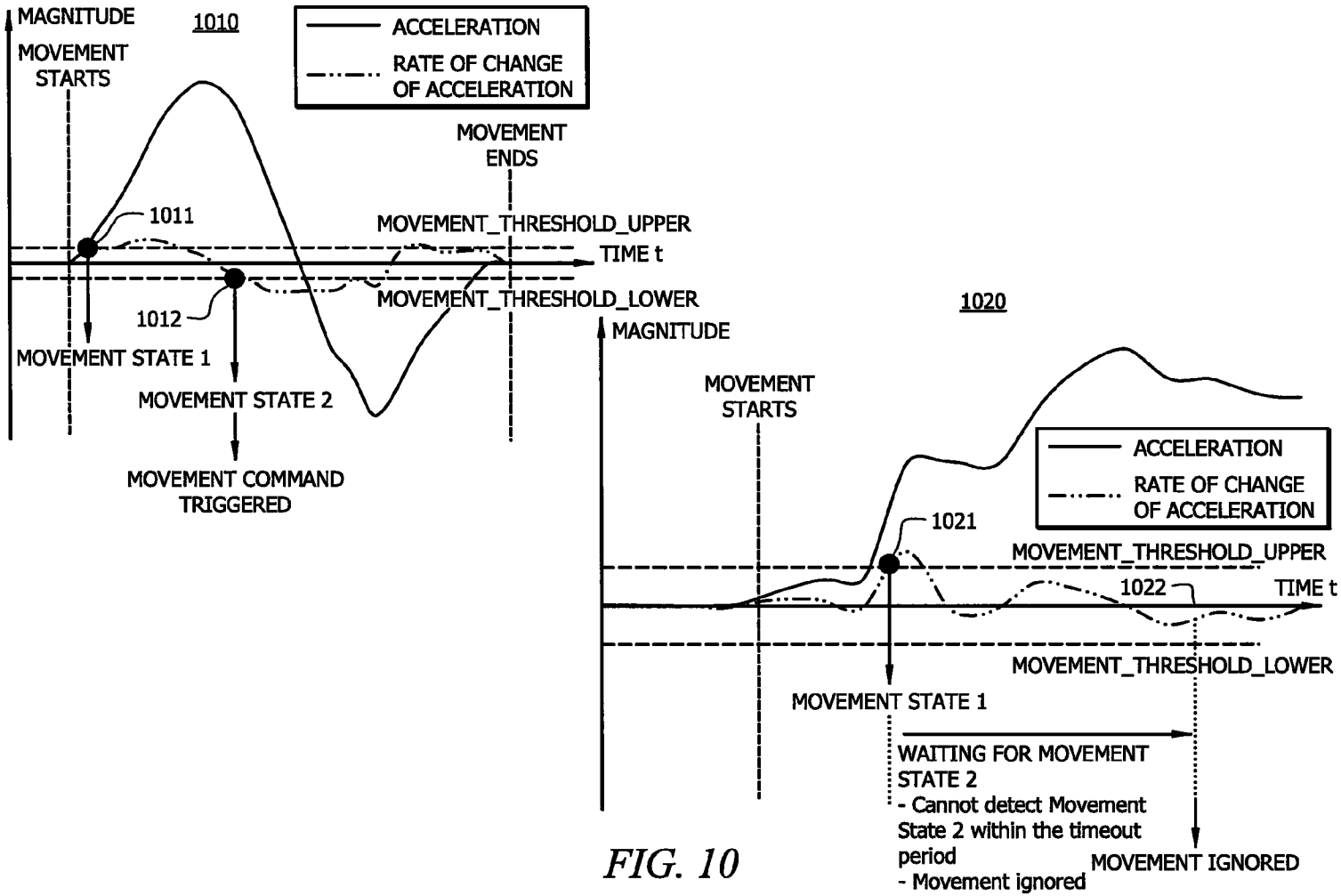
FIG. 10 is an illustration of two exemplary motion scenarios according to one embodiment of the invention.

FIG. 10 is an illustration of two exemplary motion scenarios according to an embodiment of the invention. In scenario 1010, a movement command is triggered. At time 1011, the rate of change of acceleration is positive and significant, and the algorithm 604*c* is in movement state 1, wherein the algorithm 604*c* discerns whether the rate of change of acceleration becomes significantly negative within a defined time period. At time 1012, the processor discerns that the rate of change of acceleration has become significantly negative within the defined time period and triggers the movement-based command in response thereto.

In scenario 1020, the processor discerns that the rate of change of acceleration has become significantly positive, and algorithm 604*c* advances to movement state 1. However, in scenario 1020, the rate of change of acceleration does not become significantly negative before the defined period ends at time 1022. Accordingly, algorithm 604*c* ignores the movement and does not trigger a movement-based command. After a movement-based command is triggered or a movement is ignored, a dead zone period will be initiated during which algorithm 604*c* will not be advanced to movement state 1. The implementation of a dead zone in some embodiments can help to avoid false triggering of a movement command caused by trailing data fluctuation.

Figure 11:
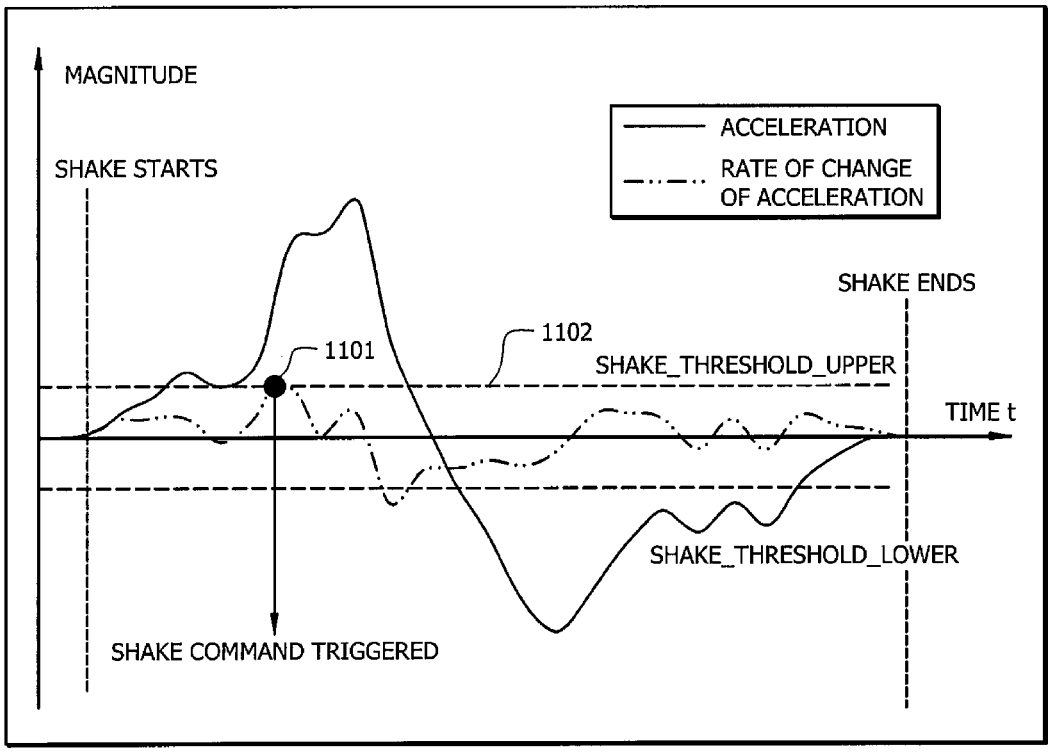
FIG. 11 is an illustration of a scenario wherein a shake command is triggered according to one embodiment of the invention.

Returning to FIG. 6, algorithm 604*d* receives user input in the form of movement of the remote control and, if the movement fits a profile (described below), algorithm 604*d* outputs a discrete command, such as stand by. FIG. 11 is an illustration of a scenario wherein a shake-based command is triggered according to an embodiment of the invention. Algorithm 604*d* calculates the rates of change of acceleration along various axes (e.g., X, Y, Z-axes in a 3-D scenario). A shake-based command is triggered when at least one of the rates is larger than a predefined threshold. In the example of FIG. 11, a shake-based command is triggered at time 1101 when the rate of change of acceleration on one of the axes exceeds threshold 1102. Similar to the movement-based command of algorithm 604*c*, a dead zone can be implemented after a shake-based command is triggered in order to avoid false shake commands from trailing data fluctuations.

Various embodiments can run algorithms 604*a*-604*d* concurrently or separately according to one or more protocols. In one example, the processor in the remote control determines which of the algorithms 604*a*-604*d* to run based on user commands received at buttons S1-S4 (FIG. 3). In one example, S1 corresponds to tilt-based pointing, S2 corresponds to a tilt-based command, S3 corresponds to movement-based command, and S4 corresponds to a shake-based command. The scope of embodiments is not limited to any particular button mapping nor is the scope of embodiments limited to requiring buttons over another type of interface device.

Additionally or alternatively, the magnitudes of the algorithms 604*a*-604*d* can be tuned to values such that a tilt-based command will be triggered before a movement-based command is triggered, which in turn will be triggered before a shake-based command is triggered. For instance, if magnitude of acceleration is within a first range, the processor triggers a tilt-based command; if acceleration is within a second range higher than the first range, the processor triggers a movement-based command. If magnitude of acceleration is within a third range higher than the second range, then the processor implements a shake command.

Additionally or alternatively, when several commands are triggered simultaneously, the application running on a host device (e.g., a web browsing application running on a television set top box) can distinguish which command to handle according to the state of the host device. For instance, if the host device is showing a web browser interface, it can use context to know to obey a tilt-based pointing command while ignoring a shake command (or vise versa) when such action is appropriate. Any protocol now known or later developed that specifies when to run algorithms concurrently or separately can be adapted according to an embodiment of the invention.

Returning to FIG. 6, in block 605, the remote control transmits a discrete command and/or pointing data to an entertainment device using IR and/or RF techniques. While FIG. 6 is shown as a series of discrete steps, the invention is not so limited. Various embodiments may add, omit, modify, and/or rearrange the actions of method 600. For instance, some embodiments include receiving user input other than tilting, moving, or shaking (e.g., input from dedicated action buttons, such as 301-305 of FIG. 3) and transmitting instructions based upon such user input.

Various embodiments include two modes for capturing sensor data. In one mode, the sensor data is captured while the user presses and holds a button, such as S1 of FIG. 3. In the examples to follow, such mode is referred to as the press and hold mode. In another example, a user presses and releases a button (e.g., S1 of FIG. 3) to begin capture of sensor data and presses and presses the button again to end capture of the sensor data. In the examples to follow, such a mode is referred to as toggle mode. Furthermore, in the examples to follow, discrete commands not associated with sensor data are sent from the remote control to the host (e.g., an entertainment unit or a television) in both high- and low-bandwidth embodiments. By contrast, in the examples to follow, sensor data is sent from the remote control to the host in high-bandwidth embodiments, and the host maps the sensor data to instructions. In low-bandwidth embodiments, an instruction mapped from the sensor data is sent from the remote control to the host in low-bandwidth embodiments.

In the examples to follow, reference characters correspond to processes as shown below.

A Reset MCU and MEMS Sensor

B Initiate variables, array, buffer, etc., e.g., Key_Type=NULL, Toggle_Status=OFF, Key_Code, Pointing_Data, Command; Buffer, Output, Sensor_Stat=OFF, etc.

C Scan Conventional Key to see if any key is pressed down;
- if pressed: Set Key_Type=CONVENTIONAL, Set Key_Code, Set Output=Key_Code; Scan Sensor Key to see if any key is pressed down;
- if pressed: Set Key_Type=SENSOR; Update Toggle_Status (if current Toggle_Status=ON, then set Toggle_Status=OFF; if current Toggle_Status=OFF, then set Toggle_Status=ON D Get sensor data from accelerometer E Pre-process/filter data F Calculate cursor position and return result to Pointing_Data; set Output=Pointing_Data G Calculate data characteristic; detect movement and return result to Command; set Output=Command H Put Output in Buffer I Rearrange Buffer using Preemptive Algorithm (give priority to specific outputs, e.g., Conventional Keys, in the buffer)

Figure 12:
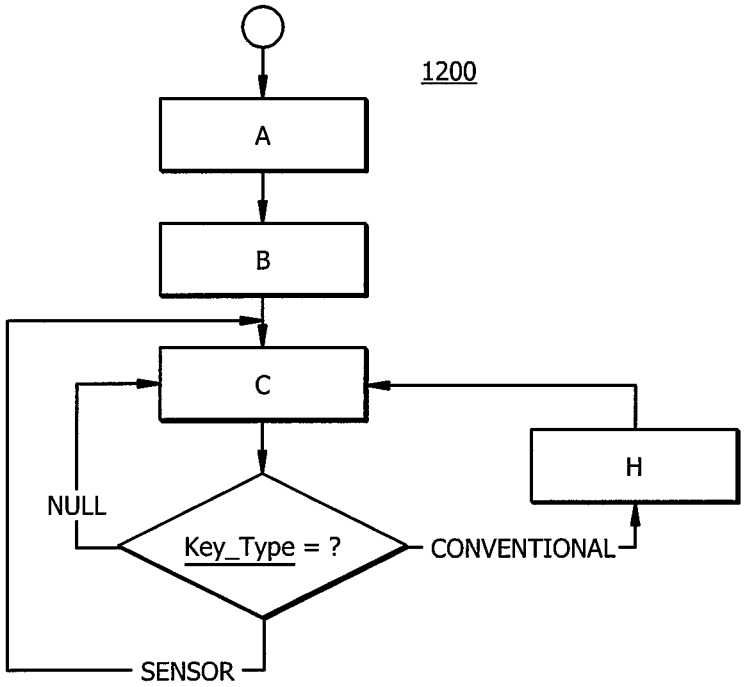
FIG. 12 is an illustration of two exemplary processes adapted according to one embodiment of the invention.
Figure 12:
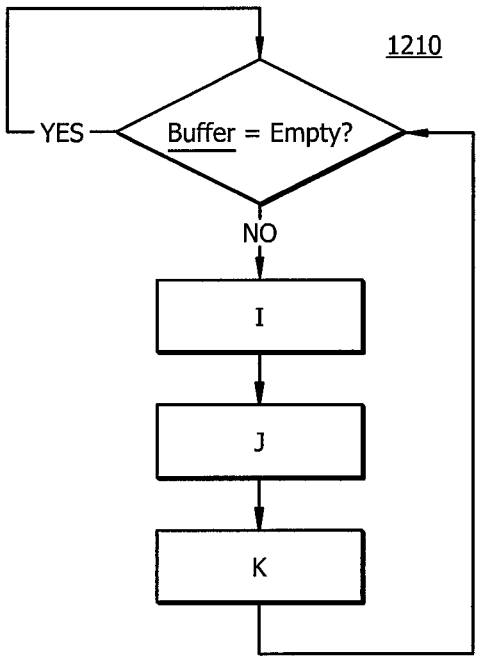

J Convert Output in Buffer, Key_Code, Pointing_Data or Command to standard command ready to send out K Send out command in Buffer according to transmission protocol L Turn on sensor; set Sensor_Stat=ON M Turn off sensor; set Sensor_Stat=OFF N Receive the data/command through IR receiver O Verify the integrity and correctness of data/command; correct or ignore the wrong data pack P Decode and interpret the data/command Q Apply the command to certain applications on the User Interface FIG. 12 shows exemplary processes 1200 and 1210 adapted according to one embodiment of the invention. Processes 1200 and 1210 are common to remote controls in both high- and low-bandwidth operation and in press and hold and toggle modes. In process 1200, the sensor and processor are initialized and it is discerned whether and which keys are pressed. Examples of sensor keys include S1 of FIG. 3, and examples of conventional keys include key 301 of FIG. 3. In process 1210, sensor data and/or data that represents a command is buffered and transmitted. In some embodiments, the buffer is rearranged to give priority to some data over other data.

Figure 13:
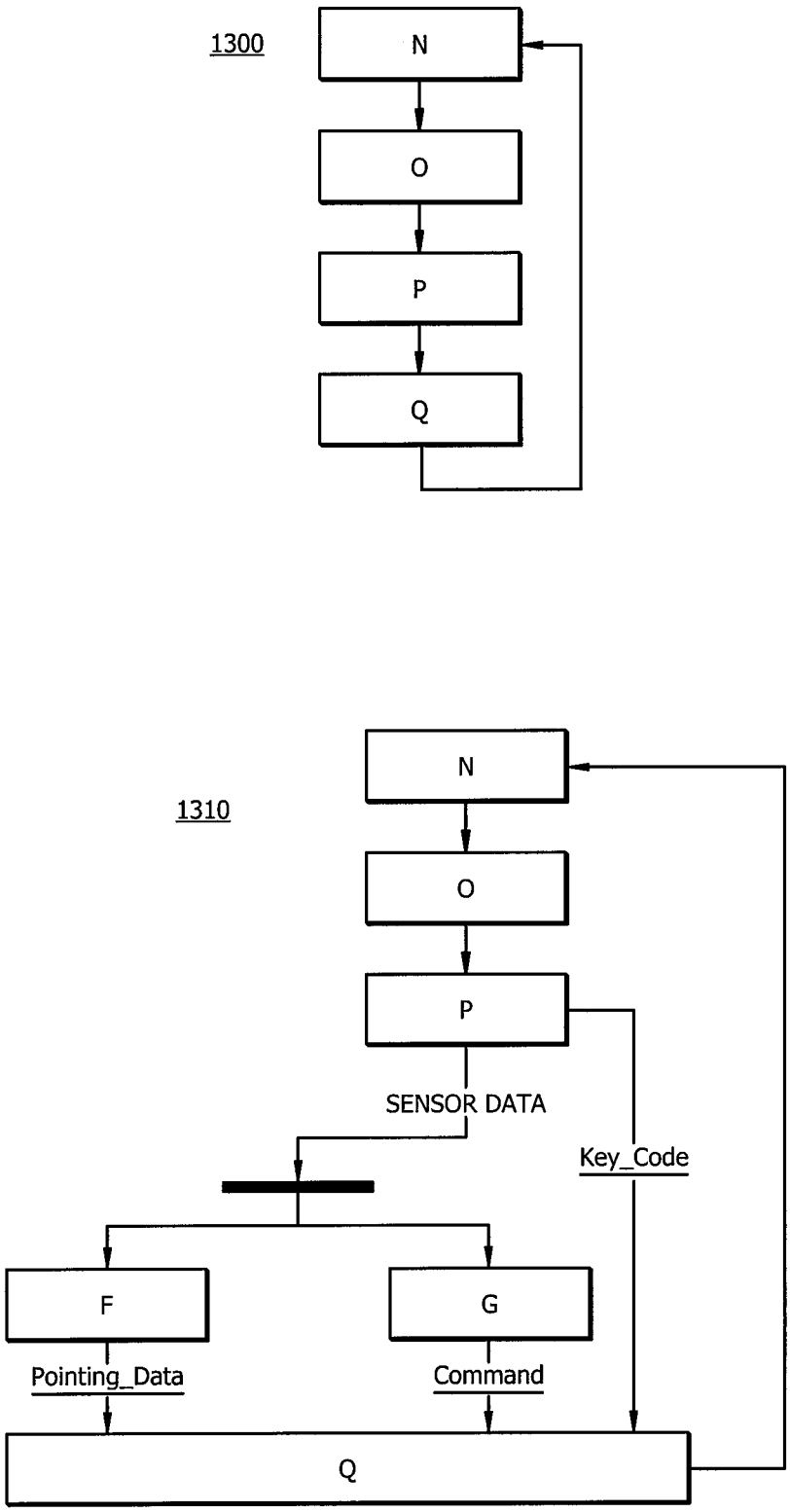
FIG. 13 is an illustration of two exemplary processes performed by a host and adapted to one embodiment of the invention.

FIG. 13 shows exemplary processes 1300 and 1310, performed by a host, and adapted according to one embodiment of the invention. Process 1300 corresponds to a low-bandwidth embodiment in which discrete commands and sensor data-based commands are sent to the host. The entertainment device receives the command data and verifies, interprets, and applies the command.

Process 1310 corresponds to a high-bandwidth embodiment wherein sensor-data, rather than sensor data-based commands are sent to the host. Additionally, as mentioned above, discrete commands from conventional keys are sent to the host. Process 1310 is similar to process 1300, but in process 1310, the entertainment device (rather than the remote control) performs algorithms to map the sensor data to instructions.

Figure 14:
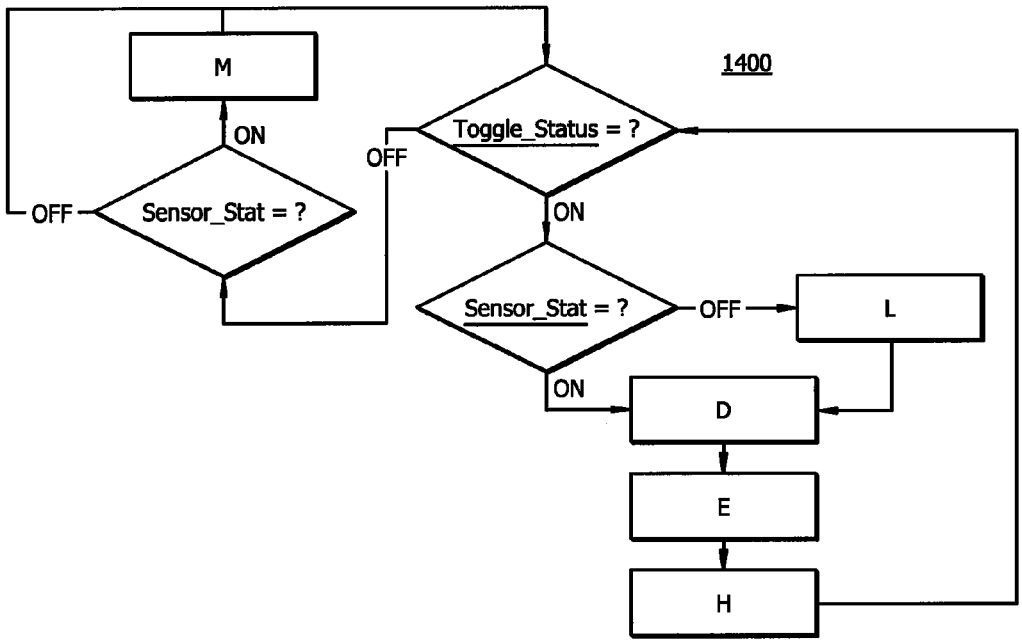
FIG. 14 is an illustration of exemplary processes performed by a remote control in a toggle mode, and adapted according to one embodiment of the invention.
Figure 14:
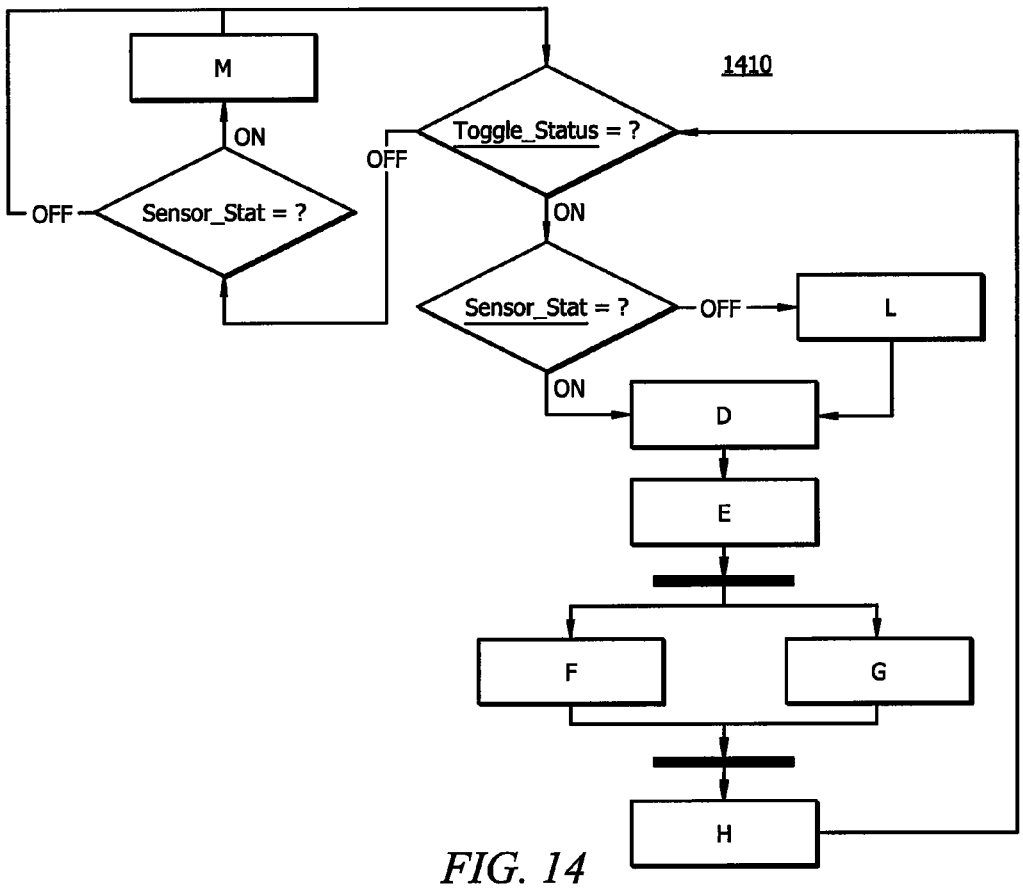

FIG. 14 shows exemplary processes 1400 and 1410, performed by a remote control in a toggle mode, and adapted according to one embodiment of the invention. Processes 1400 and 1410 are processes for capturing and processing sensor data.

Process 1400 corresponds to a high-bandwidth operation in which sensor data is sent to the host. Process 1400 checks the toggle status and while the toggle operation is performed, process 1400 gathers and preprocesses sensor data and sends the preprocessed sensor data to the buffer.

Process 1410 corresponds to a low-bandwidth operation in which sensor data-based commands are mapped at the remote control. Process 1410 is similar to process 1400, but also includes algorithms to map the sensor data to instructions.

Figure 15:
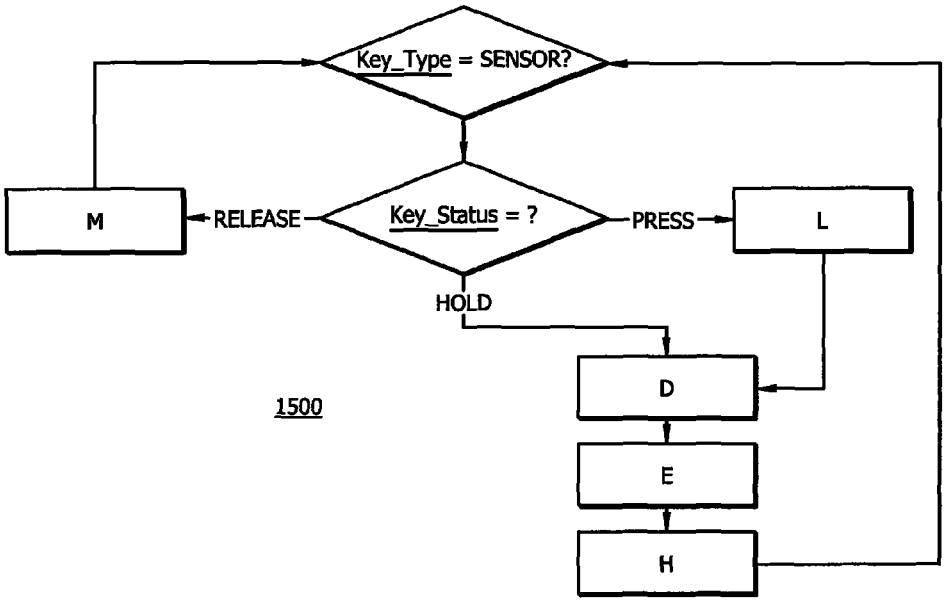
FIG. 15 is an illustration of two exemplary processes performed by a remote control in a press and hold mode, and adapted according to one embodiment of the invention.
Figure 15:
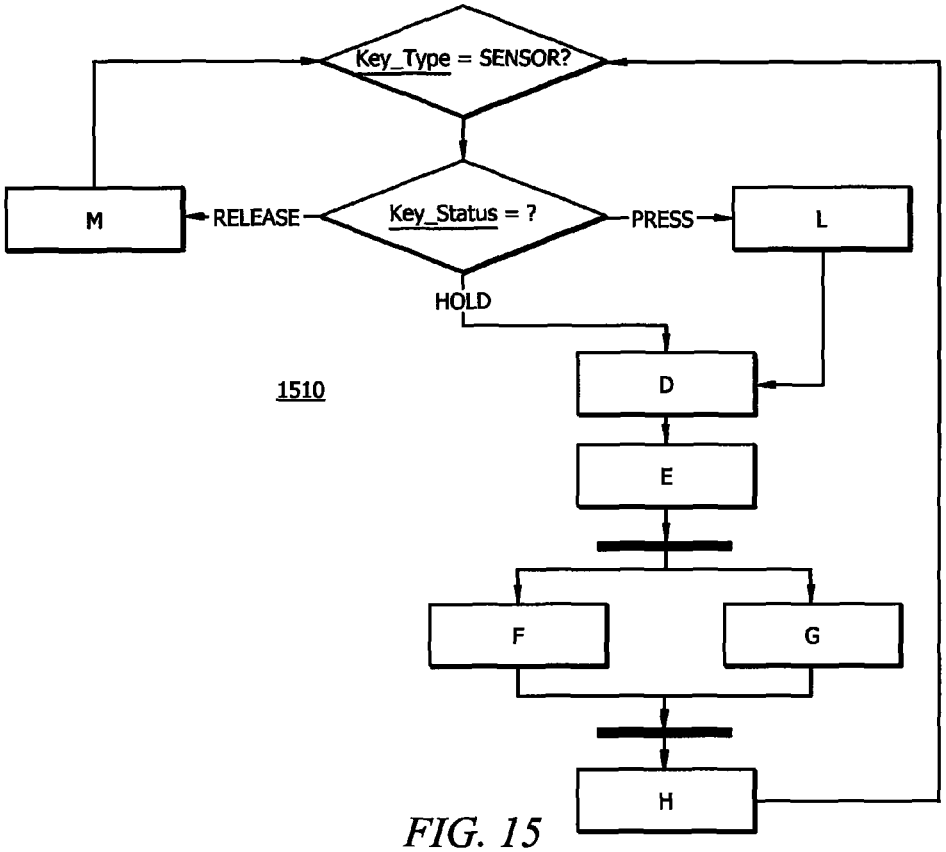

FIG. 15 shows exemplary processes 1500 and 1510, performed by a remote control in a press and hold mode, and adapted according to one embodiment of the invention. Processes 1500 and 1510 are processes for capturing and processing sensor data.

Process 1500 corresponds to a high-bandwidth operation in which sensor data is sent to the host. Process 1500 checks the press and hold status and while the press and hold operation is performed, process 1500 gathers and preprocesses sensor data and sends the preprocessed sensor data to the buffer.

Process 1510 corresponds to a low-bandwidth operation in which sensor data-based commands are mapped at the remote control. Process 1510 is similar to process 1500, but also includes algorithms to map the sensor data to instructions.

Various embodiments include one or more advantages. Specifically, embodiments wherein the movement sensor is limited to a single 2-D or 3-D accelerometer may benefit from simplicity, which can help to keep processing overhead and costs low. Furthermore, some embodiments using the zero-delay averaging filter, the zero well filter, and/or the high/low clip filter combination include sophisticated raw data filtering that is provided with minimal delay and minimal processing overhead.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A remote control device comprising:

a motion detector consisting of a single accelerometer;

means for receiving data from the motion detector and mapping the received motion detector data to at least one user instruction; and means for transmitting a signal indicative of the at least one user instruction, wherein the transmitting means comprise low-bandwidth transmitting means.

2. The remote control device of claim 1 in which the accelerometer includes an item selected from the list consisting of:

a two-dimensional (2-D) accelerometer and a three-dimensional (3-D) accelerometer.

3. A remote control device comprising:

a motion detector consisting of a single accelerometer;

means for receiving data from the motion detector and mapping the received motion detector data to at least one user instruction, wherein the at least one user instruction comprises one or more of a tilt-based pointing, a tilt-based command, a movement-based command, and a shake-based command; and means for transmitting a signal indicative of the at least one user instruction.

4. The remote control device of claim 3 in which algorithms implementing the tilt-based pointing, the tilt-based command, the movement-based command, and the shake-based command are run concurrently.

5. The remote control device of claim 3 further comprising:

means for assigning magnitudes to each of the algorithms to cause the tilt-based command to be triggered before the movement-based command and to cause the movement-based command to be triggered before the shake command.

6. The remote control device of claim 1 in which the means for transmitting a signal comprise:

means for transmitting an infrared signal in the NEC protocol.

7. The remote control device of claim 1 in which the data received from the accelerometer comprises raw data.

8. A remote control device comprising:

a motion detector consisting of a single accelerometer;

means for receiving data from the motion detector and mapping the received motion detector data to at least one user instruction, wherein the data received from the accelerometer comprises raw data; and means for transmitting a signal indicative of the at least one user instruction, wherein the means for receiving data comprise means selected from the group consisting of:

a zero-delay average filter smoothing the raw data:

a zero-well filter reducing noisy fluctuation in the raw data;

a low clipping filter reducing abrupt change in the raw data; and a high clipping filter identifying at least one dominant change in the raw data.

9. The remote control device of claim 1 in which the receiving and mapping means receive raw data from the accelerometer, detect a tilt of the accelerometer and map the tilt to a two-dimensional screen.

10. The remote control device of claim 9 further comprising:

a user interface device in communication with the receiving and mapping means, the user interface device indicating a tilt-based pointing command.

11. The remote control device of claim 9 in which the receiving and mapping means performs at least one of the following functions:

mapping fewer than three dimensions of the tilt; mapping three dimensions of the tilt;

implementing the mapping as a table look-up; and including a scaling factor during the mapping, the scaling factor associated with a resolution of a host device.

12. A remote control device comprising:

a motion detector consisting of a single accelerometer;

means for receiving data from the motion detector and mapping the received motion detector data to at least one user instruction, wherein the receiving and mapping means receive raw data from the accelerometer, detect a tilt of the accelerometer and map the tilt to a two-dimensional screen, and wherein the receiving and mapping means detect the tilt by discerning that the tilt exceeds at least one threshold; and means for transmitting a signal indicative of the at least one user instruction.

13. The remote control device of claim 1 in which the receiving and mapping means detect translational movement of the accelerometer and map the translational movement to the at least one user instruction.

14. The remote control device of claim 13 in which detecting the translational movement comprises detecting increasing acceleration in a direction followed by decreasing acceleration in the direction.

15. The remote control device of claim 13 in which the receiving and mapping means wait for a time period after detecting the translational before advancing a subsequent movement detection algorithm.

16. A remote control device comprising:

a motion detector consisting of a single accelerometer;

means for receiving data from the motion detector and mapping the received motion detector data to at least one user instruction, wherein the receiving and mapping means detect a shaking of the accelerometer and map the shaking to the at least one user instruction; and means for transmitting a signal indicative of the at least one user instruction.

17. The remote control device of claim 16, in which the receiving and mapping means detect a shaking by discerning that a rate of change of acceleration exceeds at least one threshold.

18. A method performed by a remote control device with a motion sensing unit, the motion sensing unit consisting of a single accelerometer, the method comprising:

receiving raw data from the single accelerometer;

filtering the raw data by a filtering unit to produce processed accelerometer data;

using at least one algorithm to associate the processed accelerometer data with an instruction for operation of an entertainment unit; and transmitting the instruction to the entertainment unit.

19. The method of claim 18, in which filtering the raw data comprises:

averaging the raw data using an averaging filter that provides an output after receiving a single sample of the raw data.

20. The method of claim 18, in which filtering the raw data comprises:

using a zero-well filter that comprises a high threshold and a low threshold to zero-out samples of the raw data that are between the high and low thresholds and to decrease a magnitude of other samples of the raw data that are outside of the high and low thresholds.

21. The method of claim 18, in which filtering the raw data comprises:

passing the raw data through a high-clip filter and a low-clip filter.

22. The method of claim 18, in which using at least one algorithm to associate the processed accelerometer data with the instruction comprises:

measuring rate of change of acceleration to trigger a movement-based command.

23. The method of claim 18, in which using at least one algorithm to associate the processed accelerometer data with the instruction comprises:

measuring rate of change of acceleration to trigger a shaking-based command.

24. A remote control device comprising:

a motion detector consisting of a single accelerometer;

means for receiving data from the motion detector and processing the data using one or more filters to produce filtered data; and means for transmitting a signal that includes the filtered data, wherein the transmitting means comprise high-bandwidth transmitting means.

25. A method performed by a remote control device with a motion sensing unit, the motion sensing unit consisting of a single accelerometer, the method comprising:

receiving raw data from the single accelerometer;

filtering the raw data by a filtering unit to produce processed accelerometer data; and transmitting the processed accelerometer data to an entertainment unit, wherein the transmitting comprises high-bandwidth transmission.

26. The method of claim 25, in which filtering the raw data comprises at least one of:

averaging the raw data using an averaging filter that provides an output after receiving a single sample of the raw data;

using a zero-well filter that comprises a high threshold and a low threshold to zero-out samples of the raw data that are between the high and low thresholds and to decrease a magnitude of other samples of the raw data that are outside of the high and low thresholds; and passing the raw data through a high-clip filter and a low-clip filter.

* * * * *